US005965984A

United States Patent [19]

Horiuchi et al.

[11] Patent Number: 5,965,984

[45] Date of Patent: Oct. 12, 1999

[54] INDIUM HALIDE AND RARE EARTH METAL HALIDE LAMP

[75] Inventors: Makoto Horiuchi, Sakurai; Kiyoshi Takahashi, Neyagawa; Mamoru Takeda, Soraku-gun, all of Japan

[73] Assignee: Matsushita Electric Industrial Co., Ltd., Osaka, Japan

[21] Appl. No.: 08/733,594

[22] Filed: Oct. 18, 1996

[30] Foreign Application Priority Data

Oct. 20, 1995 [JP] Japan ..... 7-272647

[51] Int. Cl.[6] ..... H01J 17/20; H01J 61/12; H01J 61/18; H01J 61/16

[52] U.S. Cl. ..... 313/637; 313/638; 313/643

[58] Field of Search ..... 313/637, 630, 313/640, 641, 638, 639, 571, 573, 576, 642–43

[56] References Cited

U.S. PATENT DOCUMENTS

| | | | |
|---|---|---|---|
| 3,514,659 | 5/1970 | Gungle et al. . | |
| 3,654,506 | 4/1972 | Kühl et al. | 313/641 |
| 3,988,629 | 10/1976 | White et al. | 313/630 |
| 4,799,135 | 1/1989 | Inukai et al. | 313/579 |
| 4,801,846 | 1/1989 | Kramer et al. | 313/640 |
| 5,479,065 | 12/1995 | Sugimoto et al. | 313/638 X |

FOREIGN PATENT DOCUMENTS

| | | |
|---|---|---|
| 0386601 | 9/1990 | European Pat. Off. . |
| 0605248 | 7/1994 | European Pat. Off. . |
| 3-219546 | 9/1991 | Japan . |

OTHER PUBLICATIONS

Higashi, Tadatoshi, "Radiation Characteristics of Metal Halide Lamps with Rare Earth Halide Additives," Journal of Lighting Society (with English Abstract), vol. 65, No. 10, 1981, pp. 17–22.

*Primary Examiner*—Sandra O'Shea
*Assistant Examiner*—Mack Haynes
*Attorney, Agent, or Firm*—Smith, Gambrell & Russell

[57] ABSTRACT

A metal halide lamp includes a light transmitting container filled with a rare gas, a halide of indium in an amount of 0.1 mg/cc to 1.5 mg/cc, at least one halide of a rare earth element selected from terbium, dysprosium, holmium, erbium, or thulium. The metal halide lamp has an emission spectrum distributed over the visual inspection range, a high luminous efficacy, a high color temperature, and long lifetime.

25 Claims, 14 Drawing Sheets

INDIUM HALIDE AND RARE EARTH METAL HALIDE LAMP

BACKGROUND OF THE INVENTION

1. Field of the Invention

The present invention relates to a metal halide lamp used as a light source of a liquid crystal projector and the like.

2. Description of the Prior Art

Recently, liquid crystal projectors or the like are known as means for enlarging and projecting an image of characters, figures, etc. Since a certain optical output is required for such an image projector, a metal halide lamp, which has a high luminous efficacy, is widely used as a light source for the image projector in general. In this kind of metal halide lamp, as disclosed in Japanese Unexamined Patent Publication No. 3-219546 for example, an iodide of Nd, Dy, and Cs has been generally used as a halide to be filled in an arc tube.

The lamp in which the iodide of Nd, Dy and Cs is filled (hereinafter described as Dy—Nd—Cs—I series lamp), as disclosed in Japanese Unexamined Patent Publication No. 3-219546, has an excellent luminous efficacy, however, it has the disadvantage that devitrification occurs in an early stage of its lifetime, particularly because of high reactivity between neodymium iodide ($NdI_3$) and silica glass of the arc tube. The lack of transparency decreases the intensity of light beam, reduces the luminous intensity and disperses the light beam, resulting in nonuniform illumination intensity and reduced brightness on a screen of the liquid crystal projector. Specifically, the drawback of the Dy—Nd—Cs—I lamp as use as the light source of a liquid crystal projector is that the lifetime of the liquid crystal projector is short.

Recently, from the viewpoint of saving energy, there is a demand for a light source having a higher luminous efficacy than that of the Dy—Nd—Cs lamp. "Luminous characteristics of metal halide lamp containing rare earth halide" (Journal of Lighting Society, vol. 65 No. 10, 1981, page 17) discloses that a light source having a high luminous efficacy can be obtained by combining a rare earth halide with a halide of Tl or In. However, the low correlated color temperature of the light source disclosed therein is unsuitable for a light source of such things as a liquid crystal projector. An example of a light source disclosed therein is a metal halide lamp in which InI and $TmI_3$ are filled, and a correlated color temperature estimated from the relative spectral distribution diagram disclosed therein is about 4500 K. On the other hand, a white color reference for an image projector such as liquid crystal projectors is about 9000 K.

SUMMARY OF THE INVENTION

An object of the present invention is to provide a metal halide lamp as an alternative of a prior art Dy—Nd—Cs—I series lamp or In—Tm—I series lamp. The metal halide lamp has an emission spectrum distributed all over the visual inspection range, a high luminous efficacy, an appropriate color temperature and a long lifetime.

A metal halide lamp of the present invention comprises a light transmitting container in which, in addition to a start-up rare gas, at least a halide of In, and a halide of Tb, Dy, Ho, Er, Tm, or a mixture of said Tb, Dy, Ho, Er, Tm are filled, wherein 0.1 mg/cc to 1.5 mg/cc of the halide of In is filled.

In the metal halide lamp, the halide of Tb, Dy, Ho, Er, Tm, or a mixture of said Tb, Dy, Ho, Er, Tm is filled to such an extent that an evaporable amount of said halide depending on the temperature of said halide is the minimum filler amount and 3.0 mg/cc of said halide is the maximum thereof.

In the metal halide lamp, lighting is conducted with a lamp power having a tube wall load of 48 $W/cm^2$ to 62 $W/cm^2$.

In the metal halide lamp, filled materials in the light transmitting container are excited by electromagnetic wave externally supplied and begin to emit.

In the metal halide lamp, a halogen of the halide of In is iodine or bromine.

In the metal halide lamp, a halogen of the halide of a rare earth element is iodine or bromine.

In the metal halide lamp, the lamp is operated by AC current.

In the metal halide lamp, a pair of electrodes to be electrically connected to an external power supply is arranged so that a distance between the pair of electrodes is 5 mm or less.

Figure 1:
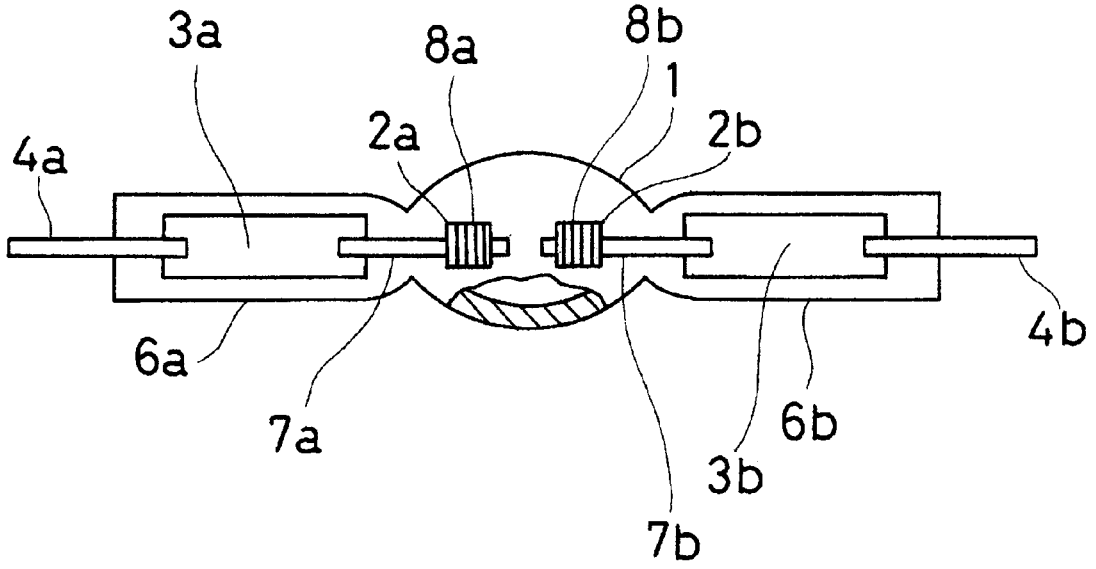
FIG. 1 is a view showing the construction of a metal halide lamp of an embodiment 1 of the invention.

1 arc tube
2*a* electrode
2*b* electrode
10 light source
11 light beam condensing mirror
12 projection lens system
13 screen

PREFERRED EMBODIMENTS

Referring to the drawings, preferred embodiments of the invention are described in detail below.

A first problem of the prior art Dy—Nd—Cs—I series lamp is that, since the reactivity of $NdI_3$ and silica glass of an arc tube is intense, devitrification of a arc tube occurs at an early stage of its lifetime. This problem can be solved if a material having a lower devitrification level (weaker reactivity with silica glass) than that of $NdI_3$ is used for the filler of the lamp.

From this viewpoint, devitrification levels of various metal halides are evaluated firstly by the following devitrification evaluation test. In the devitrification test, an ampoule composed of a tube made of silica glass, having a content volume of 5 cc and filled with 10 mg of metal halide, is heated at 1,100° C. for 100 hours, and then a total transmittance of the ampoule is measured in order to evaluate the devitrification characteristic of the metal halide. The ratios (%) of the total transmittances of the ampoules after heating (after the test) to the total transmittances thereof measured before heating are shown in Table 1. A larger percentage means a lower level devitrification. Blanks in the table indicate that evaluation was not conducted.

TABLE 1

| Material | Total transmittance (%) | Material | Total transmittance (%) |
|---|---|---|---|
| $NdI_3$ | 94.6 | $NdBr_3$ | 97.0 |
| $TbI_3$ | 98.0 | $TbBr_3$ | |
| $DyI_3$ | 94.8 | $DyBr_3$ | 99.0 |
| $HoI_3$ | 98.1 | $HoBr_3$ | |
| $ErI_3$ | 98.6 | $ErBr_3$ | |
| $TmI_3$ | 98.7 | $TmBr_3$ | 99.0 |
| InI | 99.0 | InBr | |
| $SnI_3$ | 99.0 | $SnBr_3$ | 99.0 |

As shown in Table 1, the total transmittances of ampoules filled with $TbI_3$, $HoI_3$, $ErI_3$, $TmI_3$, InI, $SnI_3$, $DyBr_3$, $TmBr_3$, InBr and $SnBr_3$, respectively, are larger than the total transmittance of an ampoule filled with $NdI_3$, and indicate a low level devitrification characteristic.

Accordingly various characteristics of combinations of these materials with a low level devitrification characteristic are investigated. As a result, as described below, excellent lifetime and luminous efficacy characteristics are obtained by adding a halide of Tb, Dy, Ho, Er, or Tm, or a mixture of these, to a halide of In.

(Embodiment 1)

FIG. 1 is a view showing a metal halide lamp of a first embodiment of the invention. In FIG. 1, reference numeral 1 denotes a light transmitting container as an arc tube made of quartz, at both ends of which sealing portions 6*a*, 6*b* are formed. To the sealing portions 6*a*, 6*b*, respectively, metal foil conductors 3*a*, 3*b* made of molybdenum are tightly attached. To these metal foil conductors 3*a*, 3*b*, respectively, electrodes 2*a*, 2*b*, and outer lead wires 4*a*, 4*b* made of molybdenum are electrically connected, The electrodes 2*a*, 2*b* are composed of tungsten rods 7*a*, 7*b* and tungsten coils 8*a*, 8*b*, respectively. The coils 8*a*, 8*b* are electrically fixed to tip portions of the tungsten rods 7*a*, 7*b* by welding, and serve as radiators of the electrodes 2*a*, 2*b*. The electrodes 2*a*, 2*b* are arranged in the arc tube 1 so as to face each other and maintain a distance of 3.5±0.5 mm therebetween.

The arc tube 1 is nearly spherical, and has an inner diameter of about 10.8 mm, an inner volume of about 0.7 cc, and an inner surface area of about 3.6 $cm^2$, in which 0.4 mg (0.57 mg/cc) of InI as a filling material, 1 mg (1.43 mg/cc) of $HoI_3$ as a rare earth iodide, 35 mg of Hg as a buffer gas, and 200 mbar of Ar as a start-up rare gas are filled.

The metal halide lamp having the above-mentioned construction was supplied with electric power via external lead wires 4*a*, 4*b* to be lit with a rated lamp power of 200 W (tube wall load: 55 W/$cm^2$) and the emission characteristic was evaluated.

Figure 2:
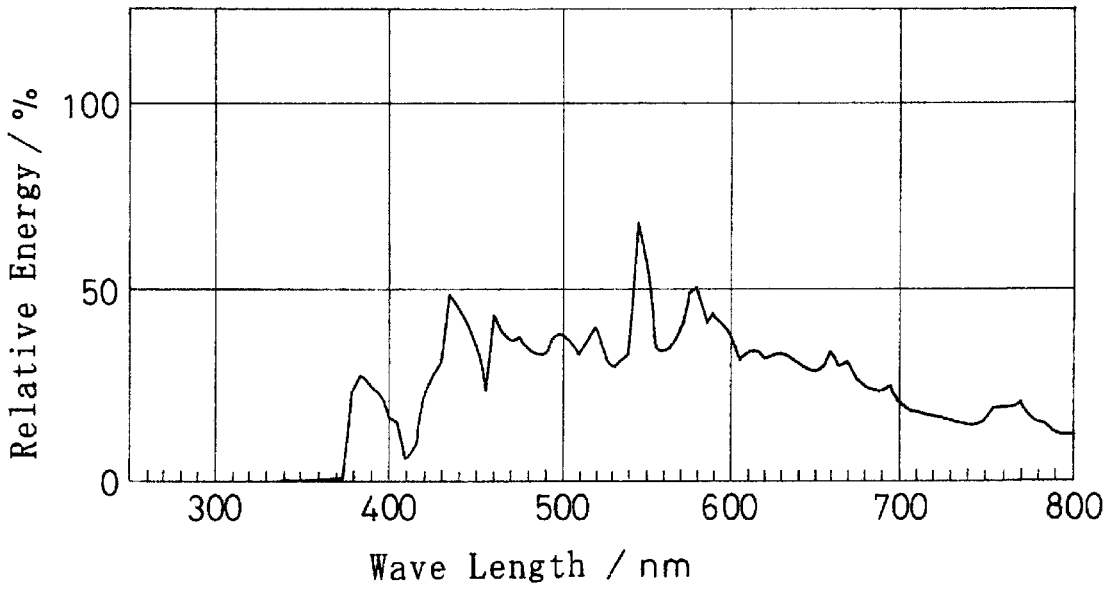
FIG. 2 is a diagram showing a distribution of the metal halide lamp of the embodiment 1 of the invention.

FIG. 2 is a diagram showing a spectrum distribution of the metal halide lamp of this embodiment. The correlated color temperature and luminous efficacy of this case were respectively about 5500 K and about 87 lm/W. Rich emission is seen all across the visible range. The emission in the red color range is particularly rich.

For the purpose of comparison, a lamp in which 1 mg of $DyI_3$, 1 mg of $NDI_3$, and 1 mg of CsI are filled in lieu of InI and $HoI_3$, and the other constructive details are the same as those of the metal halide lamp of the embodiment of FIG. 1 (hereinafter described as Dy—Nd—Cs—I lamp) was evaluated. The luminous efficacy of the comparative metal halide lamp when being lit with the rated power was 77 lm/W. These results indicate that the metal halide lamp of this embodiment has a good luminous efficacy.

Next, various different lamps were fabricated wherein filler amounts of InI and $HoI_3$ differed and the other constructive details were the same as those of the metal halide lamp of the embodiment of FIG. 1. Examination was conducted on luminous efficacy of these lamps at the time they are operated with the rated power and further, on basic characteristics of the metal halide lamp in which InI and $HoI_3$ are filled. The results will be described referring to FIGS. 3, 4 and 5.

Figure 3:
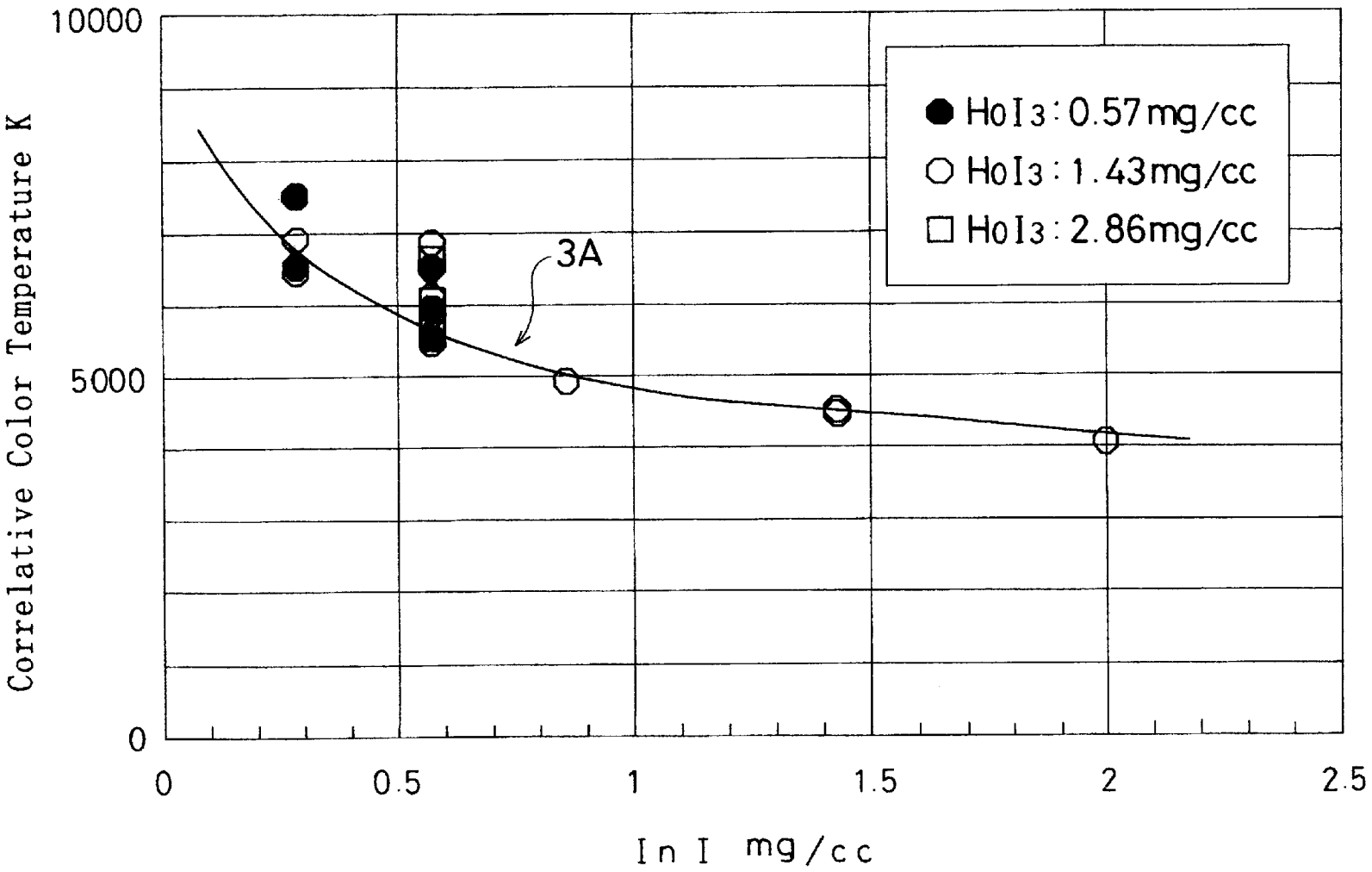
FIG. 3 is a diagram showing the relation between amount of iodide filled in the lamp and correlated color temperature in the embodiment 1 of the invention.

FIG. 3 is a diagram showing the relation between the filler amount (mg) of InI per unit volume (axis of abscissa) and correlation color temperature (K) (axis of ordinate) wherein filler amounts of $HoI_3$ are taken as a parameter. Three marks ●, ○, □ in FIGs. indicate lamps in which the filler amounts of $HoI_3$ are 0.57, 1.43 and 2.86 mg/cc, respectively.

As seen in FIG. 3, it was found that the correlated color temperature highly depends on the filler amounts of InI, as shown in curve 3A in the figure. However, the effect of filler amounts of $HoI_3$ on the correlation color temperature is relatively low. This is caused by the fact that InI generally conducts an unsaturated action, and $HoI_3$ generally conducts a saturated action.

The correlated color temperature required for use as a light source depends on the usage purpose. When it is used for a light source of a liquid crystal projector or like apparatus, it is preferable that the correlated color temperature of the light source is about 4500 K or more. When the temperature is less than 4500 K, such bad conditions is occurred that the white color temperature on a screen becomes slightly yellow color temperature. It is preferable that the correlated color temperature of the light source is about 9000 K which is used as a white color reference in many liquid crystal projector or like apparatus. Results provided in FIG. 3 show that a preferable filler amount of InI in correspondence to the requirement of such various relatively high correlated color temperatures is 0.1 mg/cc to 1.5 mg/cc in the metal halide lamp of the embodiment.

Additionally, it is apparent from the following description, that the range of preferable filler amounts of InI in correspondence to the requirement of such various relatively high correlated color temperature can apply to other lamp which has different tube wall load from that of the lamp of this embodiment.

Figure 14:
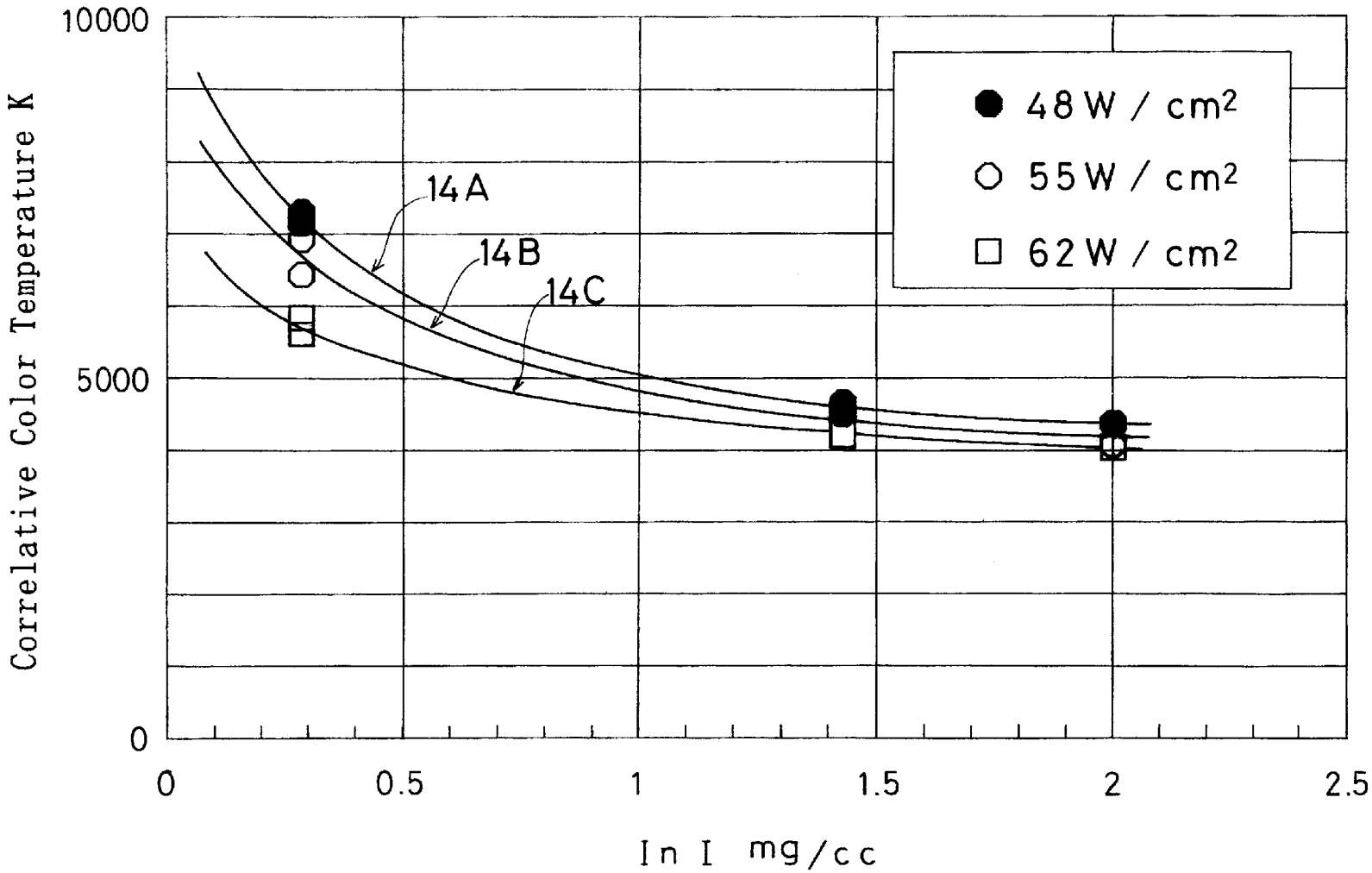
FIG. 14 is a diagram showing a relation between the tube wall load and the correlated color temperature in the embodiment 1 of the invention.

Lamps in which each amount of InI is different and the other constructive details are the same as those of the metal halide lamp of the embodiment of FIG. 1, are operated by various powers and the correlated color temperatures of the lamps are detected. The results are shown in FIG. 14. In the FIG. 14 the curves 14A, 14B, 14C show respectively the relations between the correlated color temperature and the filler amount of InI under 175 W (tube wall load: about 48 W/cm$^2$), 200 W (tube wall load: about 55 W/cm$^2$), and 225 W (tube wall load: about 62 W/cm$^2$). As a result it is apparent that preferable correlated color temperature of about 4500 K–9000 K can be obtained by such filler amount of InI of 0.1 mg/cc to 1.5 mg/cc even for different tube wall loads. But the higher the tube wall load is, the lower the correlated color temperature becomes. While the correlated color temperature is about 6800 K at a tube wall load of 55 W/cm$^2$ when the filler amount of InI is 0.57 mg/cc, the correlated color temperature is about 5800 K at a tube wall load of 62 W/cm$^2$. But the more the filler amount of InI is, the less such lowering of the color temperature becomes. When the filler amount of InI is about 1.5 mg/cc, the variation ratio of the correlated color temperature against such change of tube wall load of 55 W/cm$^2$ to 62 W/cm$^2$ is less than 5% and it can be negligible. Such results show that the correlated color temperature of about 4500 K or more can be obtained by making the filler amount of InI being 1.5 mg/cc or less irrespective of amount of the tube wall load.

Figure 4:
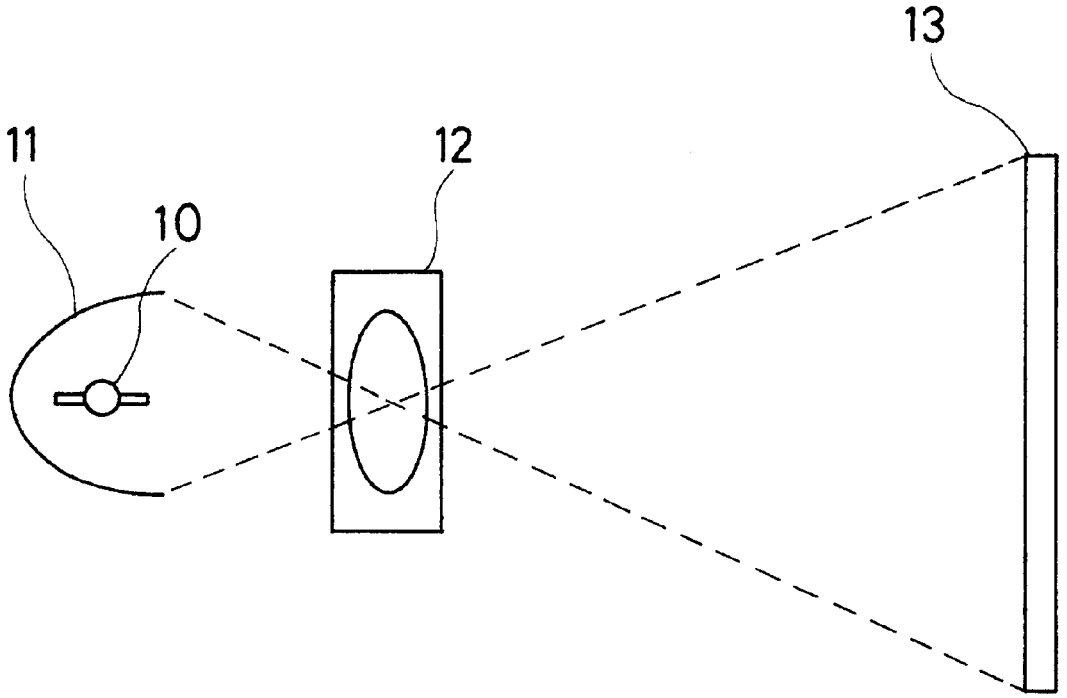
FIG. 4 is a view showing the construction of an optical system used for lifetime evaluation of a metal halide lamp of the invention.
Figure 5:
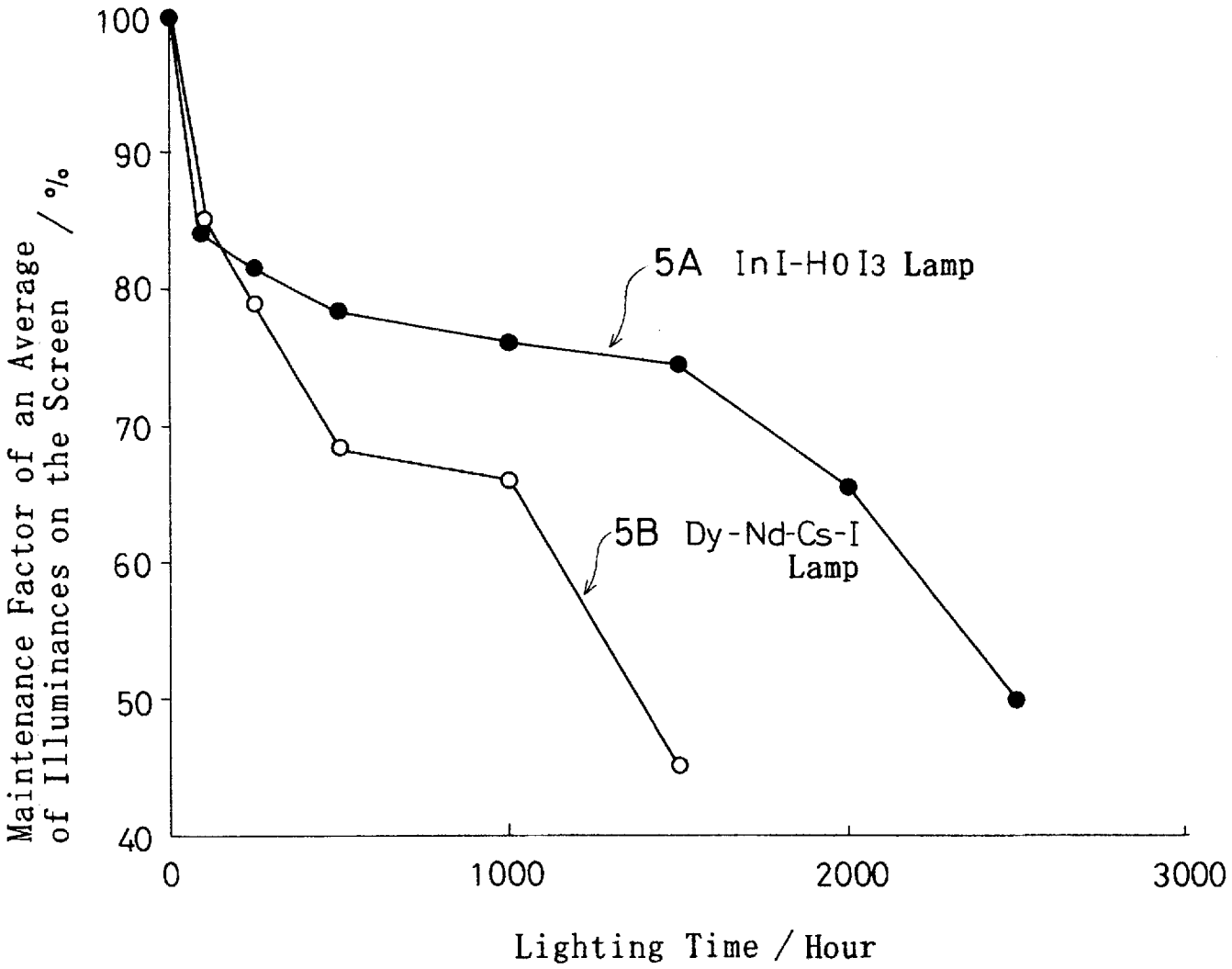
FIG. 5 is a diagram showing the relation between lighting time and illuminance maintenance factor of the metal halide lamp of the embodiment 1 of the invention.

Next, the metal halide lamp of the embodiment was used as a light source for an optical system as shown in FIG. 4 to evaluate a maintenance factor of screen 13 illuminance to lighting time. In FIG. 4, reference numeral 10 denotes a light source, reference numeral 11 denotes a converging mirror which reflects and converges light radiated from the light source 10 and reference numeral 12 denotes a projection lens system which projects the light converged by the converging mirror on the screen 13. Evaluation results are shown in FIG. 5 (curve 5A). In FIG. 5, the axis of abscissa indicates lighting time and the axis of ordinate indicates the maintenance factor of an average of illuminances of 13 points on the screen 13. For the purpose of comparison, the results on the Dy—Nd—Cs—I lamp are also indicated (curve 5B). From these results, it is newly demonstrated that the metal halide lamp comprising InI and $HoI_3$ has a longer lifetime than that of the prior art lamp wherein $NdI_3$ is filled. These results are shown in Table 1 above, which support the results of the devitrification evaluation test.

(Embodiment 2)

Next, a lamp wherein 1 mg (1.43 mg/cc) of $TmI_3$ is filled in lieu of $HoI_3$, and the other constructive details are the same as those of the metal halide lamp of the embodiment of FIG. 1 will be described below.

Figure 6:
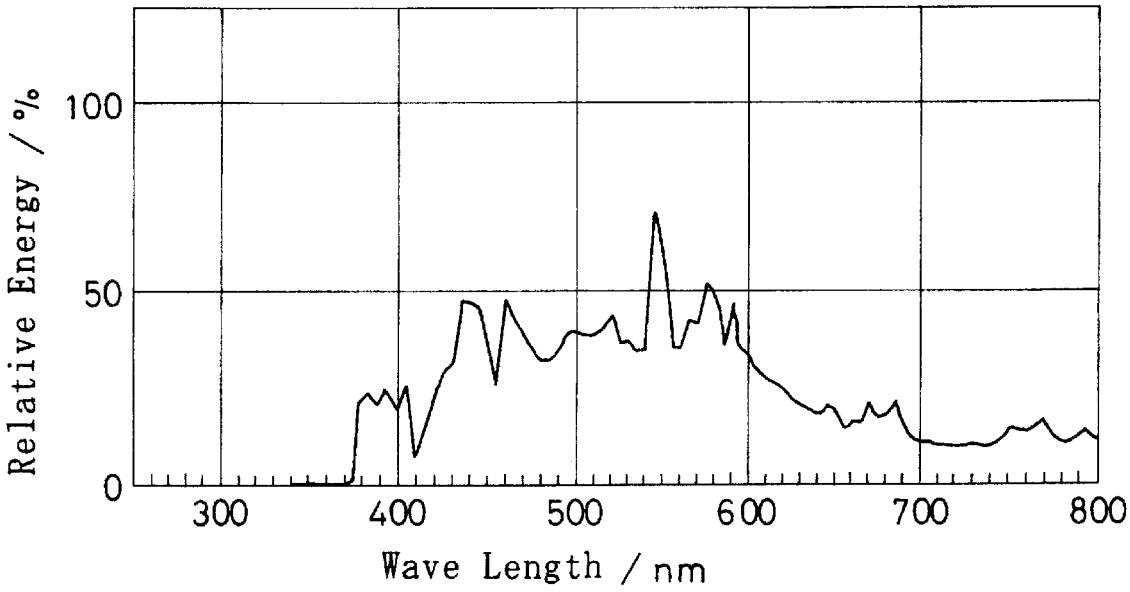
FIG. 6 is a diagram showing an emission distribution of a metal halide lamp of an embodiment 2 of the invention.

FIG. 6 is a diagram showing a spectrum distribution of the metal halide lamp of the embodiment. The correlated color temperature and luminous efficacy in the case are about 6400 K and about 94 lm/W, respectively.

The lamp wherein $TmI_3$ replaces $HoI_3$ is characterized by having a higher luminous efficacy than that of the embodiment. On the other hand, emission in the red color range is less satisfactory.

With respect to the correlated color temperature, the lamp is equivalent to the lamp wherein $HoI_3$ is filled. The correlated color temperatures of the lamp of the present embodiment plotted in FIG. 3 fit to curve 3A which relates filler amounts of InI to correlated color temperatures. Accordingly, a preferable filler amount of INI in the lamp in which $TmI_3$ is used in lieu of $HoI_3$ in the present embodiment (in which a relatively high correlated color temperature is attained, which can not be attained in the prior art In—Tm—I series lamp) is 0.1 mg/cc to 1.5 mg/cc, the same as in embodiment 1.

Figure 7:
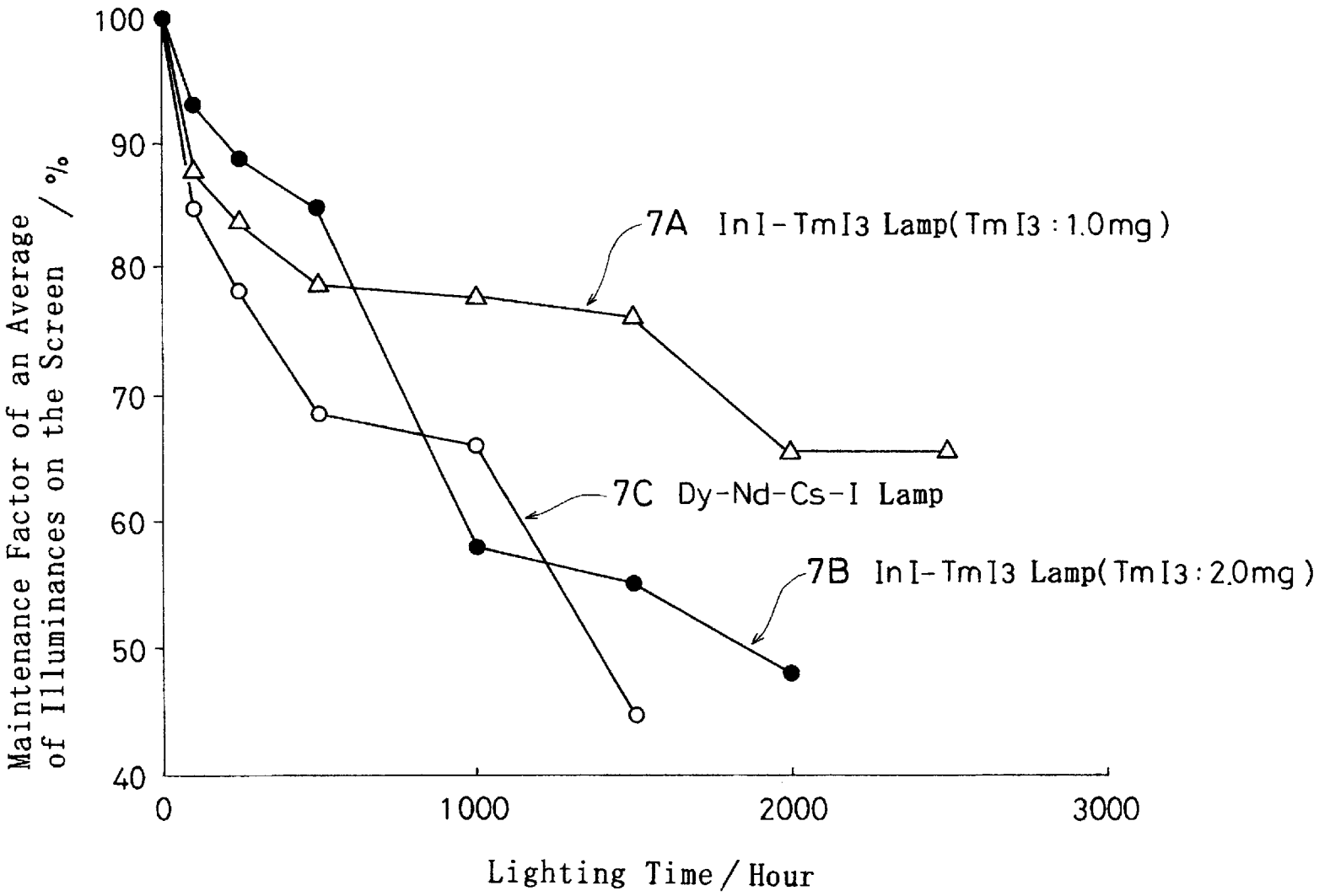
FIG. 7 is a diagram showing the relation between lighting time and illuminance maintenance factor of the metal halide lamp of the embodiment 2 of the invention.

The lamp of the present embodiment is also characterized by a long lifetime. The same as FIG. 5, FIG. 7 is a diagram (curve 7A) showing changes in maintenance factor of an average of illuminances of 13 points on the screen 13 to lighting time when the lamp of the present embodiment was used as a light source for the optical system shown in FIG. 4. In addition, the results on a lamp of the present embodiment wherein 2 mg of $TmI_3$ is filled, and the prior art Dy—Nd—Cs—I lamp are also indicated (curves 7B and 7C, respectively). The average illuminance of the screen in the prior art Dy—Nd—Cs—I lamp after about 1400 hours of lighting decreased to 50% of that of an early stage of use, while the average illuminance of the lamp of the present embodiment, even after 2000 hours of lighting, maintains 60% of that of the early stage of use. However, as shown in FIG. 7B, it was newly found that lifetime is shortened with increase of filler amount of $TmI_3$. The tendency was also observed in the $HoI_3$-filled lamp, which is described in embodiment 1. Accordingly as small as possible filler amount of $TmI_3$ is preferable for lifetime. The minimum amount of $TmI_3$ is such amount being possible to evaporate (As the vapor pressures of $TmI_3$ and $HoI_3$ are low, the whole amount of filler does not evaporate). Meanwhile an evaporable amount of said halide is determined by the temperature of said halide. The coolest temperature of the lamp of the embodiment is about 1000 K as like other general metal halide lamps and the saturation vapor pressure of $TmI_3$ at this temperature is about $4\times10^{-5}$ atm and therefore the amount of the evaporated $TmI_3$ within the lamp of 0.7 cc is about 0.0001 mg on the basis equation of gas state. However, because such an ultra small amount can not be weighed, an amount of 0.01 mg is a practical value. The maximum limitation amount is 2 mg (=about 3 mg/cc) from FIG. 7. This preferable range of filler amount of $TmI_3$ can be also applied to the $HoI_3$ -filled lamp which is described in the foregoing embodiment 1, from the same reason.

Figure 8:
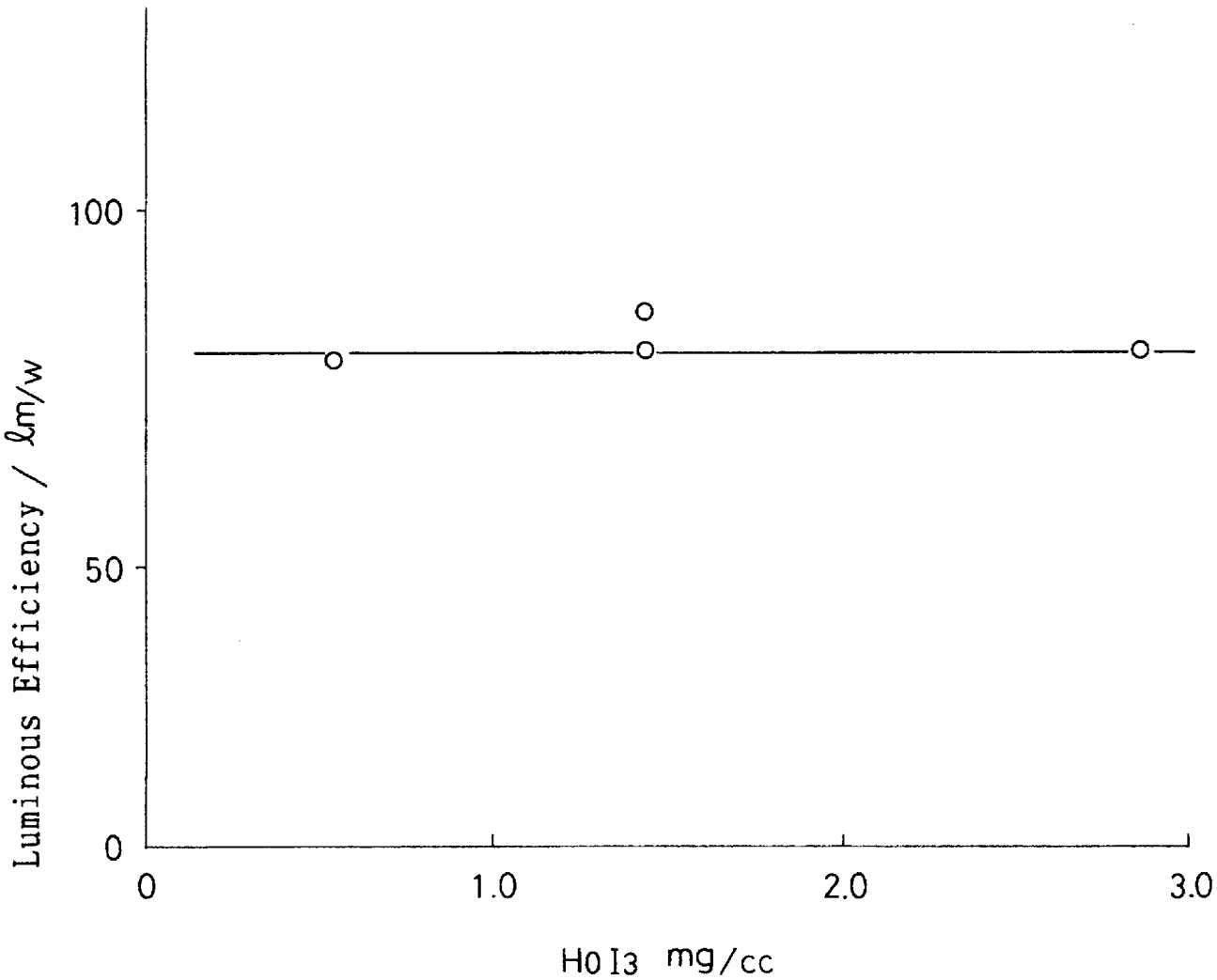
FIG. 8 is a diagram showing the relation between amount of iodide filled in the lamp and correlated color temperature in the embodiment 2 of the invention.

Additionally, even when a different amount of $TmI_3$ or $HoI_3$ is filled, $TmI_3$ and $HoI_3$ conduct saturation action, so that luminous efficacy is not adversely affected. FIG. 8 is a diagram showing the relationship between the filler amount of $HoI_3$ and the luminous efficacy in a lamp wherein $HoI_3$ replaced $TmI_3$ in the present embodiment.

(Embodiment 3)

Next, a lamp wherein 1 mg (1.43 mg/cc) of $TbI_3$ is filled in lieu of $HoI_3$, and the other constructive details are the same as those of the metal halide lamp of the embodiment of FIG. 1 will be described below.

Figure 9:
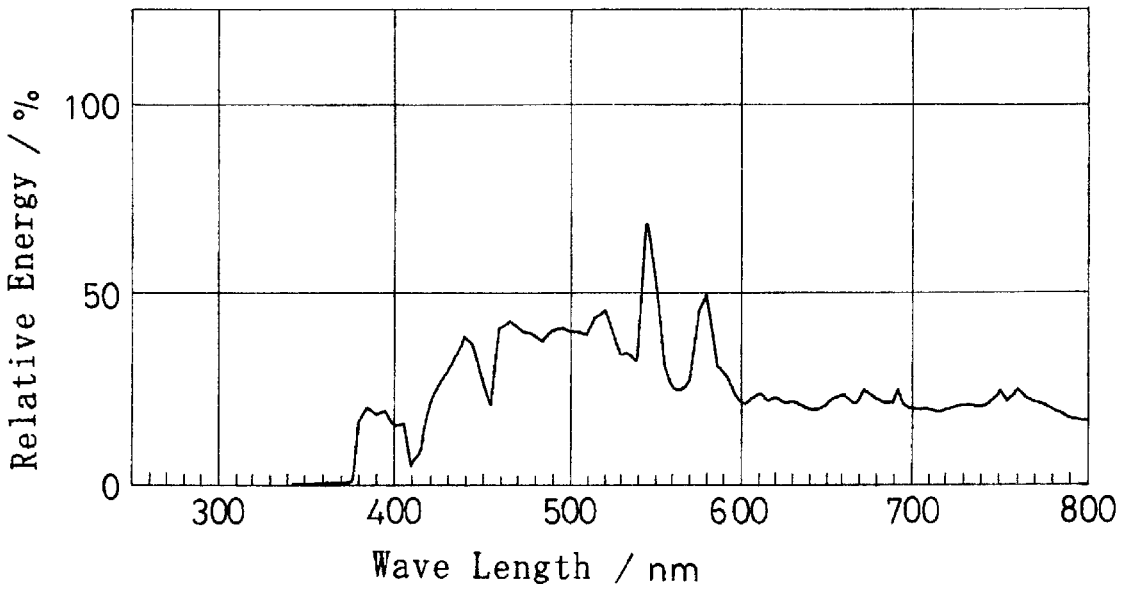
FIG. 9 is a diagram showing an emission distribution of a metal halide lamp of an embodiment 3 of the invention.

FIG. 9 is a diagram showing a spectrum distribution of the metal halide lamp of the present embodiment. The correlated color temperature and luminous efficacy in the case are about 7000 K and about 82 lm/W, respectively.

The lamp wherein $TbI_3$ replaces $HoI_3$ is characterized by having a higher correlation color temperature indicated by the present embodiment. The emission of around 500 nm wavelength, which is richer than the red color range, contributes to the higher correlation color temperature.

Additionally, the correlated color temperature and luminous efficacy of another lamp of the present embodiment, wherein 0.6 mg (0.86 mg/cc) of InI, and 2 mg (2.86 mg/cc) of $TbI_3$ are filled, are about 6300 K and about 80 lm/W, respectively.

In the lamp of the present embodiment, a preferable filler amount of InI in the lamp is 0.1 mg/cc to 1.5 mg/cc, the same as in the lamp of embodiment 1.

From the results of the devitrification test shown in Table 1 and the results of embodiments 1, 2, it is apparent that the $TbI_3$-filled lamp of the present embodiment also has a long lifetime.

(Embodiment 4)

Next, a lamp wherein 0.6 mg (0.86 mg/cc) of InI and 2 mg (2.86 mg/cc) of $ErI_3$ in lieu of $HoI_3$ are filled, and the other constructive details are the same as those of the metal halide lamp of the embodiment of FIG. 1, will be described below.

Figure 10:
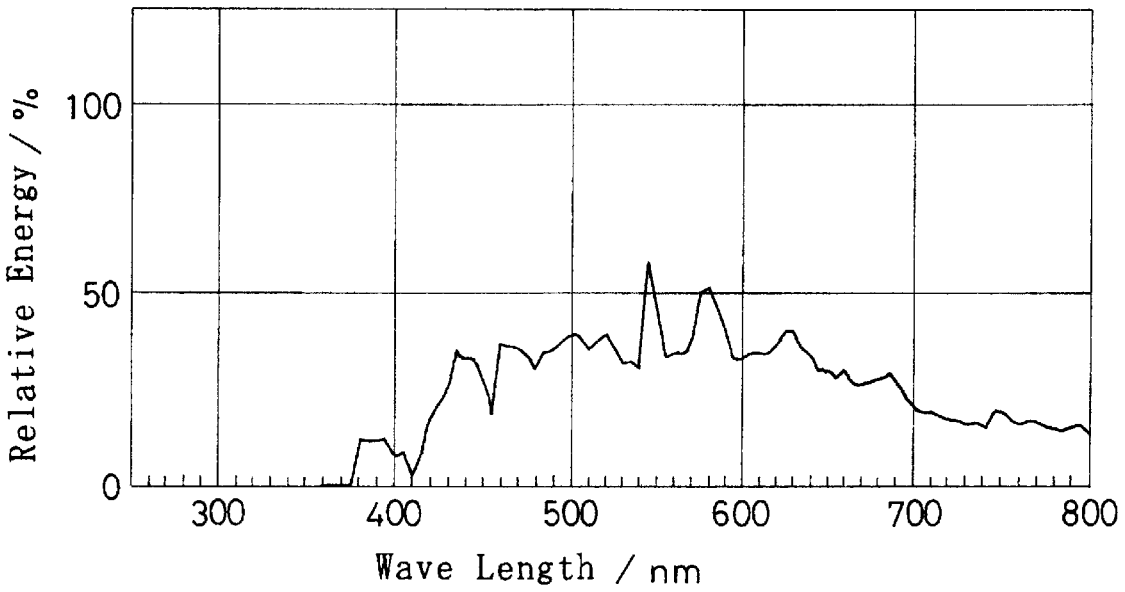
FIG. 10 is a diagram showing an emission distribution of a metal halide lamp of an embodiment 4 of the invention.

FIG. 10 is a diagram showing a spectrum distribution of the metal halide lamp of the embodiment. The correlated color temperature and luminous efficacy in the case are about 5000 K and about 86 lm/W, respectively.

The lamp of the present embodiment wherein $ErI_3$ is filled indicates the same emission distribution as that with $HoI_3$. Given this characteristic, $ErI_3$ can completely replace $HoI_3$.

In the lamp of the present embodiment, a preferable filler amount of InI is 0.1 mg/cc to 1.5 mg/cc, the same as in the lamp of embodiment 1.

A similar emission characteristic can also be obtained in a lamp of the present embodiment wherein $DyI_3$ replaces $ErI_3$. However, as apparent from Table 1 of devitrification test results, devitrification property is relatively strong, so that replacement with $DyI_3$ slightly diminishes a prominent effect to lifetime.

(Embodiment 5)

Next, a lamp will be described below wherein 0.6 mg (0.86 mg/cc) of InI and 1 mg (1.43 mg/cc) of $HoI_3$ are filled, and 1 mg (1.43 mg/cc) of $TbI_3$ is added, and the other constructive details are the same as those of the metal halide lamp of the embodiment of FIG. 1.

Figure 11:
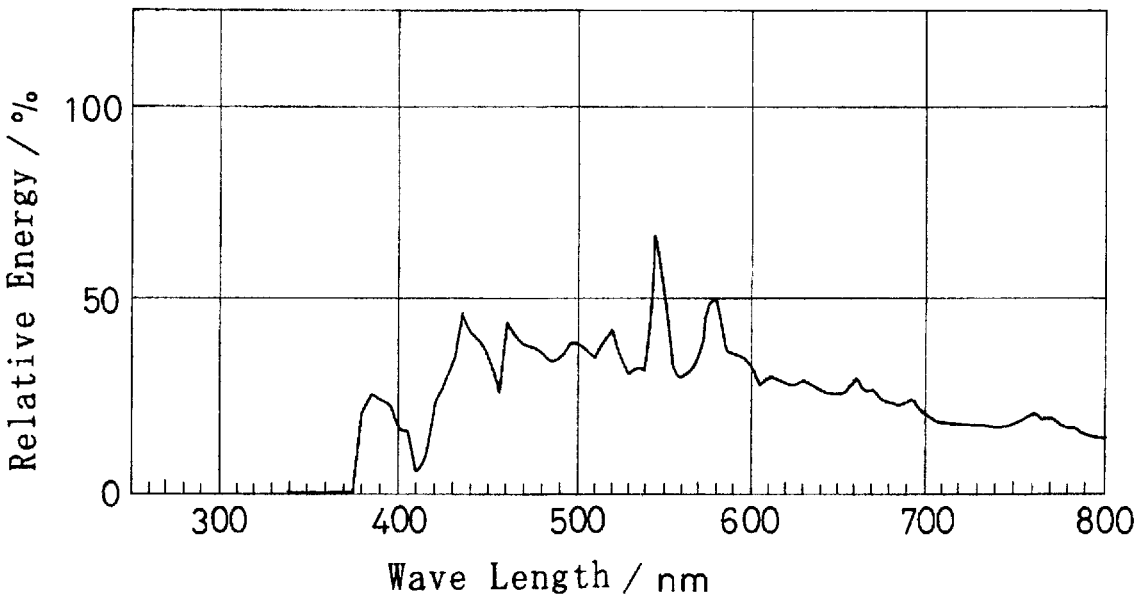
FIG. 11 is a diagram showing an emission distribution of a metal halide lamp of an embodiment 5 of the invention.

FIG. 11 is a diagram showing a spectrum distribution of the metal halide lamp of the present embodiment. The correlated color temperature and luminous efficacy in the case are about 6100 K and about 831 m/W, respectively.

The lamp wherein $TbI_3$ is added to $HoI_3$ is characterized by emission distribution in which characteristics of both $TbI_3$ and $HoI_3$ are added. Emission around 500 nm wavelength, which is richer than that of the lamp in which only $TbI_3$ is filled, is an effect produced by $TbI_3$, and emission around the red color range, which is richer than that of the lamp in which only $TbI_3$ is filled, is an effect produced by $HoI_3$.

The effects of such addition can be also attained by other combinations than the combination of $HoI_3$ and $TbI_3$. By appropriately combining $TbI_3$, $DyI_3$, $HoI_3$, $ErI_3$ and $TmI_3$, a lamp which has unique characteristics can be attained. For example, in the case of a combination of $HoI_3$ and $TmI_3$, emission of $TmI_3$ in the red color range, which is slightly less satisfactory, is improved by $HoI_3$, and a higher luminous efficacy than that of a lamp in which only $HoI_3$ is filled is produced by $TmI_3$.

(Embodiment 6)

Next, a lamp wherein 0.4 mg (0.57 mg/cc) of InBr is filled in lieu of InI, and the other constructive details are the same as those of the metal halide lamp of the embodiment of FIG. 1, will be described below.

Figure 12:
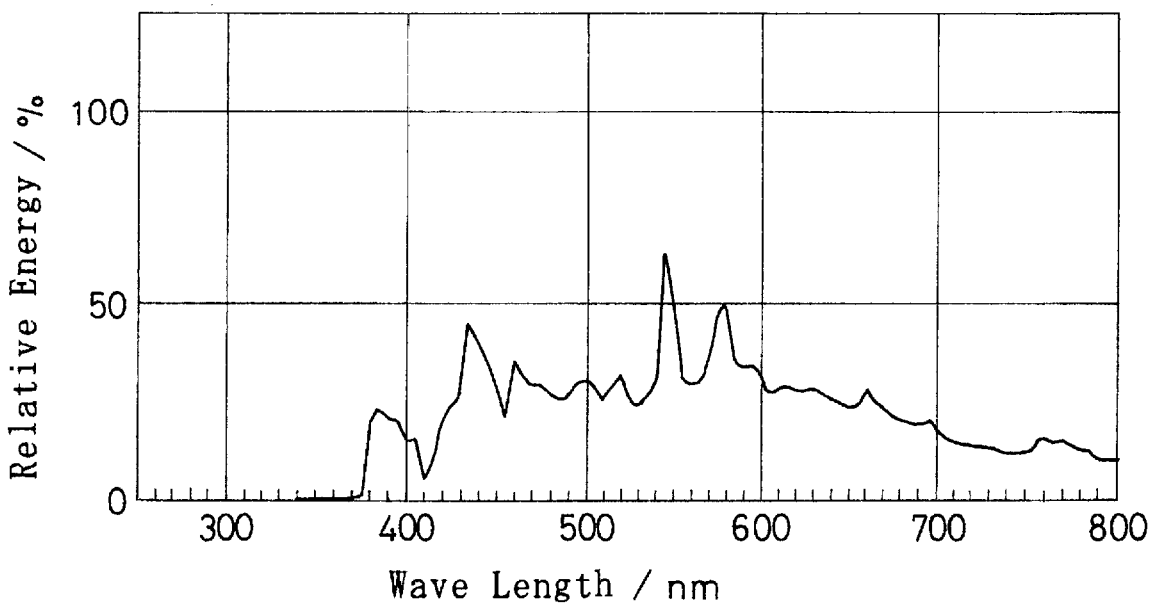
FIG. 12 is a diagram showing an emission distribution of a metal halide lamp of an embodiment 6 of the invention.

FIG. 12 is a diagram showing a spectrum distribution of the metal halide lamp of the present embodiment. The correlated color temperature and luminous efficacy in the case are about 5300 K and about 801 m/W, respectively.

As indicated by the present embodiment, change in emission distribution due to the replacement by InBr was not observed. With respect to this point, the replacement of InI by InBr is possible. Additionally as apparent from devitrification test results in Table 1, no adverse effect on lifetime was found. However, luminous efficacy is slightly lessened.

The replacement of InI by InBr is not limited to the case of the combination with $HoI_3$, as indicated in the present embodiment. It is possible in combinations with $TbI_3$, $DyI_3$, $ERI_3$, $TmI_3$ as well as a mixture of these iodides. Additionally, bromides may be used in lieu of iodides, and iodides may be combined with bromides.

(Embodiment 7)

Next, a lamp wherein 1 mg (1.43 mg/cc) of $HoBr_3$ is filled in lieu of $HoI_3$ and the other constructive details are the same as those of the metal halide lamp of the embodiment of FIG. 1 will be described below.

Figure 13:
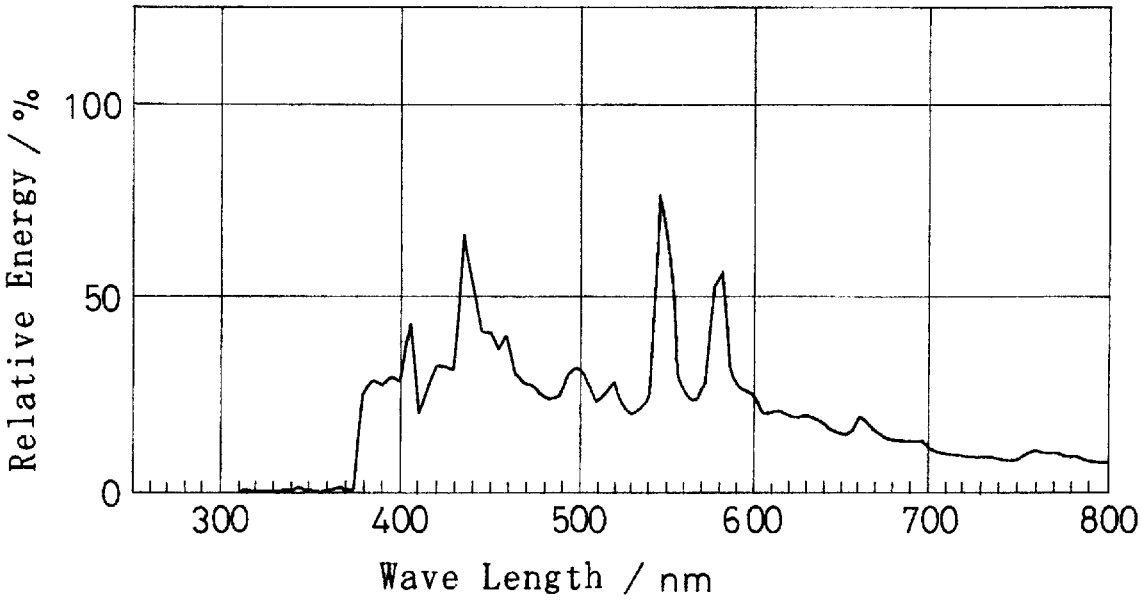
FIG. 13 is a diagram showing an emission distribution of a metal halide lamp of an embodiment 7 of the invention.

FIG. 13 is a diagram showing a spectrum distribution of the metal halide lamp of the present embodiment. The correlated color temperature and luminous efficacy in the case are about 7200 K and about 74 lm/W, respectively.

A lamp in which HoBr3 replaced $HoI_3$ is characterized by a higher correlated color temperature than that of the present embodiment. Emission around 440 nm wavelength largely increased. The luminous efficacy decreased by 10%, to a level equivalent to that of the conventional Dy—Nd—Cs—I lamp.

With respect to the $TmI_3$-filled lamp described in embodiment 2, another lamp in which 1 mg (1.43 mg/cc) of $TmBr_3$ was filled in lieu of $TmI_3$, it has a correlated color temperature of about 8600 K and a luminous efficacy of about 81 lm/W. The spectrum distribution of the lamp is shown in FIG. 14.

As mentioned above, alteration of iodides of Ho and Tm to the bromides thereof causes a higher correlated color temperature and a decrease of about 10% in luminous efficacy as a result. Despite the decrease in luminous efficacy, a longer lifetime is obtained than in the case of the iodides. It is demonstrated in the devitrification evaluation test results in Table 1 that Tm has a lower devitrification property in its bromide than in its iodide.

Additionally, it is apparent that even in Dy and Nd, whose iodides indicated high devitrifications, the bromides thereof indicate low devitrifications which are comparable to that of $TmBr_3$, and that the bromides of Ho, Tb and Er also result in a comparably long lifetime.

It is also the case with these bromides, alteration of InI to InBr causes no detrimental effect.

As mentioned above, by combining a halide of 0.1 mg/cc to 1.5 mg/cc of In with a halide of rare earth of Tb, Dy, Ho, Er, Tm or a mixture of elements selected from these rare earth elements, a highly efficient metal halide lamp satisfying the requirement for various relatively high correlated color temperatures can be realized. Additionally, when the filler amount of said halide of the rare earth is in such range that an evaporable amount of said halide depending on the temperature of said halide is the minimum filler amount and 3.0 mg/cc of said halide is the maximum thereof, a metal halide lamp having a further extended lifetime can be realized.

In the embodiments the arc length is 3.5±0.5 mm, but when the arc length is 5 mm or less, same merits are obtained. When the arc length is more than 5 mm, the efficacy increases but the correlated color temperature decreases.

In the case where In was replaced by Ga, which also belongs to 3B, the luminous efficacy was less than 70 lm/W. In the case where a halide of Sn, which indicated a low devitrification in the devitrification test results, and a iodide of In were combined, a luminous efficacy of 701 m/W or more could be obtained, but because of the low luminance, the lamp was unsuitable as a light source for a liquid crystal projector or the like.

Although in the aforementioned embodiments, examples of metal halide lamps having electrodes were described, a similar effect can be also obtained even in a so-called "no electrode" metal halide lamp in which no electrode is provided and a filler in the arc tube is excited and emits light.

Although, in the above, preferred embodiments were described, the present invention is not restricted to the description mentioned above, and it is to be understood that modifications will be apparent to those skilled in the art without departing from the spirit of the invention. A similar effect can be obtained even in a lamp having a different wattage and different sizes, and also in the case where a material containing Na, Cs or the like is added to a filler in order to stabilize arc, a similar effect can be obtained.

On the basis of the embodiments, it is possible, according to the invention, to obtain an economical light source having a good luminous efficacy and an emission spectrum covering the visible range, which can satisfy the requirement for various relatively high correlated color temperatures. This is made possible by, in addition to a start-up rare gas, combining at least a halide of In and a halide of a rare earth element including Tb, Dy, Ho, Er and Tm, or a halide of a mixture of those selected from these elements.

Additionally, since the progress of the reaction between a transparent container material and an additive metal is decelerated, devitrification is restricted as a consequence, and thereby a light source can be attained having a long lifetime, suitable to a light source for a liquid crystal projector, for example.

Meanwhile the currents applied to the lamps in the above mentioned embodiments are rectangular waveform of 270 Hz. It is preferable to use AC as the currents applied to the lamps in the present invention.

What is claimed is:

1. A metal halide lamp comprising a light transmitting container filled with a fill gas consisting essentially of:

a) a start-up rare gas, b) at least one halide of indium, and c) one halide of a rare earth metal selected from the group consisting of terbium, dysprosium, holmium, erbium, thulium and mixtures thereof, wherein $DyI_3$ is not present in said container, and wherein said halide of indium is present in an amount of 0.1 mg/cc to 1.5 mg/cc.

2. The metal halide lamp defined in claim 1, wherein a halogen of said halide of indium is iodine or bromine.

3. The metal halide lamp defined in claim 1, wherein a halogen of said halide of said rare earth metal is iodine or bromine.

4. The metal halide lamp as defined in claim 1, further comprising a pair of electrodes spaced 5 mm or less apart within said light transmitting container.

5. The metal halide lamp as defined in claim 1, wherein said color temperature is about 4500 K to about 9000 K.

6. The metal halide lamp as defined in claim 1, wherein said color temperature is about 5000 K to about 8600 K.

7. The metal halide lamp as defined in claim 1, wherein said color temperature is about 5300 K to about 8600 K.

8. The metal halide lamp as defined in claim 1, wherein a power per electrode distance unit is about 35 W/mm to 75 W/mm.

9. The metal halide lamp as defined in claim 1, wherein said halide of at least one rare earth metal is present in an evaporable amount, which evaporable amount depends on the temperature of said halide of rare earth metal up to a maximum amount of 3.0 mg/cc.

10. The metal halide lamp defined in claim 9, wherein a halogen of said halide of indium is iodine or bromine.

11. The metal halide lamp defined in claim 9, wherein a halogen of said halide of said rare earth metal is iodine and bromine.

12. The metal halide lamp ad defined in claim 9, further comprising a pair of electrodes spaced 5 mm or less apart within said light transmitting container.

13. The metal halide lamp as defined in claim 9, wherein said rare gas, halide of indium, and halide of a rare earth metal in said light transmitting container emit light when excited by externally supplied electromagnetic waves.

14. The metal halide lamp defined in claim 13, wherein a halogen of said halide of indium is iodine or bromine.

15. The metal halide lamp defined in claim 1, wherein lighting is conducted with a lamp power having a tube wall load of 48 $W/cm^2$ to 62 $W/cm^2$.

16. The metal halide lamp defined in claim 15, wherein a halogen of said halide of indium is iodine or bromine.

17. The metal halide lamp defined in claim 15, wherein a halogen of said halide of said rare earth metal is iodine and bromine.

18. The metal halide lamp defined in claim 15, wherein the lamp is operated by AC current.

19. The metal halide lamp as defined in claim 15, further comprising a pair of electrodes spaced 5 mm or less apart within said light transmitting container.

20. The metal halide lamp defined in claim 9, wherein lighting is conducted with a lamp power having a tube wall load of 48 $W/cm^2$ to 62 $W/cm^2$.

21. The metal halide lamp defined in claim 20, wherein a halogen of said halide of indium is iodine or bromine.

22. The metal halide lamp defined in claim 20, wherein a halogen of said halide of said rare earth metal is iodine or bromine.

23. The metal halide lamp defined in claim 20, wherein the lamp is operated by AC current.

24. The metal halide lamp as defined in claim 20, further comprising a pair of electrodes spaced 5 mm or less apart within said light transmitting container.

25. A metal halide lamp comprising a light transmitting container filled with a fill gas consisting essentially of:

a) a start-up rare gas, b) at least one halide of indium, c) $DyBr_3$ and one halide of a rare earth metal selected from the group consisting of terbium, holmium, erbium, thulium and mixtures thereof, or alternatively, $DyBr_3$ or at least one halide of a rare earth metal selected from the group consisting of terbium, holmium, erbium, thulium and mixtures thereof, wherein said halide of indium is present in an amount of 0.1 mg/cc to 1.5 mg/cc.

* * * * *